US009754578B2

(12) United States Patent
Smithers

(10) Patent No.: US 9,754,578 B2
(45) Date of Patent: Sep. 5, 2017

(54) LOUDSPEAKER HORN AND CABINET

(71) Applicant: Dolby Laboratories Licensing Corporation, San Francisco, CA (US)

(72) Inventor: Michael Smithers, Kareela (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 235 days.

(21) Appl. No.: 14/578,615

(22) Filed: Dec. 22, 2014

(65) Prior Publication Data

US 2015/0195643 A1 Jul. 9, 2015

Related U.S. Application Data

(60) Provisional application No. 61/925,604, filed on Jan. 9, 2014.

(51) Int. Cl.

| | |
|---|---|
| ***G10K 11/26*** | (2006.01) |
| ***H04R 1/30*** | (2006.01) |
| ***H04R 1/34*** | (2006.01) |
| ***H04R 1/40*** | (2006.01) |
| *H04R 1/02* | (2006.01) |
| *H04R 1/26* | (2006.01) |

(52) U.S. Cl.

CPC ..... *G10K 11/26* (2013.01); *H04R 1/30* (2013.01); *H04R 1/345* (2013.01); *H04R 1/403* (2013.01); *H04R 1/021* (2013.01); *H04R 1/26* (2013.01); *H04R 2201/34* (2013.01)

(58) Field of Classification Search

CPC ..... H04R 1/02; H04R 1/2803; H04R 1/2811; H04R 1/2834; H04R 2499/11; H04R 1/2861; H04R 1/2865; H04R 1/30; H04R 1/345; H04R 1/403

USPC ..... 381/336, 342, 341, 339, 337

See application file for complete search history.

(56) References Cited

U.S. PATENT DOCUMENTS

| | | | |
|---|---|---|---|
| 2,089,391 | A | 8/1937 | Marion |
| 2,982,372 | A | 5/1961 | Lowell |

(Continued)

FOREIGN PATENT DOCUMENTS

| | | |
|---|---|---|
| CN | 102098599 | 6/2011 |
| DE | 3333754 | 4/1985 |

(Continued)

*Primary Examiner* — Davetta W Goins
*Assistant Examiner* — Oyesola C Ojo

(57) ABSTRACT

According to various embodiments, a loudspeaker horn and cabinet are designed to achieve a sound coverage pattern characterized by narrow vertical dispersion and a wide horizontal dispersion. A loudspeaker horn may comprise at least two horn sections, each extending from an inlet to a mouth. A first plurality of outlet channels is disposed in an interleaved column with a second plurality of outlet channels. A loudspeaker cabinet may comprise a primary enclosure having a front wall, the front wall having an aperture in which a low frequency loudspeaker driver is mounted. The loudspeaker cabinet further comprises a top baffle section having a top end and a bottom baffle section having a bottom end, each extending vertically from the primary enclosure. The top baffle section has a first width that gradually increases towards the top end and the bottom section has a second width that gradually increases towards the bottom end.

19 Claims, 14 Drawing Sheets

(56) References Cited

U.S. PATENT DOCUMENTS 3,356,179 A * 12/1967 Tompkins ..... H04R 1/30 181/152
3,818,138 A 6/1974 Sperrazza
4,284,844 A 8/1981 Belles
4,314,620 A * 2/1982 Gollehon ..... H04R 1/26 181/144
4,344,504 A 8/1982 Howze
4,580,655 A * 4/1986 Keele, Jr. ..... G10K 11/025 181/187
4,878,561 A * 11/1989 Tengstrand ..... H04R 1/403 181/144
5,397,866 A * 3/1995 Lyons ..... H04R 1/30 181/141
5,715,322 A 2/1998 Yoshioka
6,112,847 A 9/2000 Lehman
6,394,223 B1 5/2002 Lehman
6,860,363 B2 3/2005 Gardner
7,218,747 B2 5/2007 Huffman
7,590,257 B1 * 9/2009 Blanchard ..... H04R 1/345 381/339
2003/0209384 A1 * 11/2003 Dalbec ..... G10K 11/025 181/182
2004/0131217 A1 7/2004 Opie
2004/0252856 A1 * 12/2004 Masuda ..... H04R 1/26 381/340
2005/0127783 A1 * 6/2005 De Vries ..... H04R 1/345 310/328
2010/0032233 A1 * 2/2010 Moore ..... H04R 1/345 181/152
2010/0092019 A1 4/2010 Hoefler
2011/0274306 A1 * 11/2011 Adams ..... H04R 1/30 381/338
2014/0093111 A1 * 4/2014 Jankovsky ..... G10K 11/025 381/340

FOREIGN PATENT DOCUMENTS

DE 102008057315 * 5/2010 ..... H04R 1/24
EP 2605540 6/2013
GB 2079097 2/1982
GB 2187061 8/1987
JP H10-322787 12/1998

* cited by examiner

LOUDSPEAKER HORN AND CABINET

CROSS-REFERENCE TO RELATED APPLICATIONS

This application is related to U.S. Provisional Application Ser. No. 61/925,604, filed on Jan. 9, 2014, entitled, "Loudspeaker Horn and Cabinet," which is incorporated herein by reference in its entirety.

TECHNOLOGY

The present invention relates generally to loudspeaker horns and cabinets. More particularly, embodiments of the present invention relate to a loudspeaker horn and cabinet designed to achieve a narrow dispersion of sound in one direction (e.g., vertically) and wide dispersion of sound in another direction (e.g., horizontally).

BACKGROUND

For many years, cinemas and other similar venues have used audio loudspeakers to distribute sound throughout a large area. In cinemas, for example, it is common to use a group of several loudspeakers, where each of the loudspeakers in the group may be placed at some position along the side and rear walls of the room. In this arrangement, each individual loudspeaker may project sound to only a portion of the audience nearest to the loudspeaker and the combined sound from all of the loudspeakers is used to cover the entire audience area.

While this arrangement is useful for distributing sound uniformly across a large audience area, recent developments in cinema sound require that each loudspeaker independently be able to provide sound to the entire audience. For example, cinema sound now often employs localized sources of sound where individual sound elements from a movie or other media content may be projected by as few as one loudspeaker of a group of loudspeakers. The ability to project individual sound elements from particular loudspeakers of a group enables sound designers to create immersive sound environments which increase the sense of realism for the audience.

In order for the entire audience to hear sound clearly from individual loudspeakers, it is desirable that each loudspeaker be able to disperse sound in a wide horizontal pattern covering the audience area. In addition, limited dispersion of sound in a vertical direction is often desirable so that sound energy is not wasted in areas where audience members typically are not located (e.g., directly above and below a loudspeaker) and so that listeners nearest the loudspeaker are not subjected to dramatically higher sound levels than listeners at the furthest distance across the room.

One way in which the directivity of sound generated by loudspeakers may be controlled is with the use of rectangular shaped horns. A horn generally is a device that may be acoustically coupled to a sound source, such as a loudspeaker, and used to more efficiently project and guide sound generated by the source. Sound generated by a source travels through a "throat" section of the horn having an outwardly expanding cross sectional area toward an outlet, or horn "mouth." Upon exiting the horn mouth, the sound exhibits a dispersion pattern that is approximately controlled by the shape of the horn. For example, a rectangular shaped horn is defined by side walls, which determine an amount of horizontal dispersion of sound emanating from the horn, and top and bottom walls, which determine an amount of vertical dispersion of sound emanating from the horn.

As indicated above, in some instances it is desirable for a loudspeaker to widely disperse sound in one direction (e.g., in a horizontal pattern) while limiting dispersion of sound in another (e.g., in a vertical pattern). One way to control the dispersion of sound in one direction relative to another is using a rectangular shaped horn having a narrow exit in one direction, also referred to as a slot exit. For example, a horn with slot exit may taper out in the vertical direction, but have a narrow and constant width in the horizontal direction for the entire length of the horn. A horn with such a slot exit generally causes sound to emanate with relatively limited vertical coverage pattern and, due to the narrow horizontal width of the slot exit causing the exiting sound to diffract, with a wide horizontal coverage pattern.

Although a horn with a slot exit generally is able to control the dispersion of sound in one direction relative to another, at sufficiently high frequencies, sound transmitted through a slot exit horn may nevertheless become more directional in both directions. For example, as the frequency of sound increases and its wavelength approaches the width of the slot exit, the diffracting effect of the slot exit is minimized. Narrower slot exits may be used in an attempt to increase diffraction of higher frequency sounds; however, there are limits to the sound energy levels that may be transmitted through narrow slots without degrading the sound quality.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1:
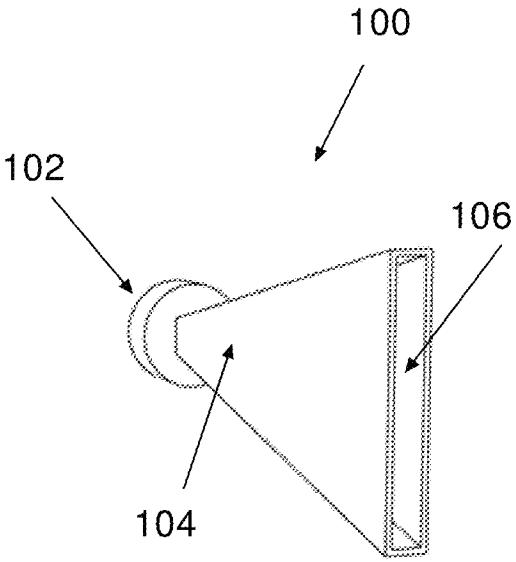
FIG. 1 is a perspective view of a loudspeaker horn having a slot exit.

Example embodiments, which relate to loudspeaker horns and cabinets, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. LOUDSPEAKER HORN
3. LOUDSPEAKER CABINET
4. LOUDSPEAKER HORN AND CABINET SYSTEM
5. EQUIVALENTS, EXTENSIONS, ALTERNATIVES AND MISCELLANEOUS

1. GENERAL OVERVIEW

This overview presents a basic description of some aspects of example embodiments of the present invention. It should be noted that this overview is not an extensive or exhaustive summary of aspects of the example embodiment. Moreover, it should be noted that this overview is not intended to be understood as identifying any particularly significant aspects or elements of the example embodiment, nor as delineating any scope of the example embodiment in particular, nor the invention in general. This overview merely presents some concepts that relate to the example embodiment in a condensed and simplified format, and should be understood as merely a conceptual prelude to a more detailed description of example embodiments that follows below.

According to embodiments of the invention described herein, a loudspeaker horn and cabinet are designed to achieve a sound coverage pattern characterized by narrow vertical dispersion and a wide horizontal dispersion of sound across a wide range of sound frequencies.

As used herein, dispersion generally refers to a directional distribution of sound from a source, such as a loudspeaker, into an area surrounding the source. The dispersion of the sound by a loudspeaker generates a coverage pattern which may be different in some directions originating from the source than others. Wide dispersion of sound means that a source radiates the sound widely and fairly consistently in many directions originating from the source. On the other hand, narrow dispersion indicates that a source radiates sound which is more focused in a particular direction and results in a coverage pattern defined by a more limited angle from the source. Depending on the shape and other characteristics of a loudspeaker, the dispersion of sound may be different in certain spatial axes (e.g., in the vertical axis relative to the horizontal axis) and may be different at different frequencies.

In some embodiments, a loudspeaker horn comprises at least two horn sections, each extending from an inlet to a mouth. The first horn section includes a first plurality of outlet channels and the second horn section includes a second plurality of outlet channels. The first plurality of outlet channels is disposed in an interleaved column with the second plurality of outlet channels. The first plurality of outlet channels is disposed in a first direction and the second plurality of outlet channels is disposed in a second direction, wherein the first direction is substantially perpendicular to the second direction.

By interleaving a column of outlet channels from two separate horn sections, sound traveling through each horn section is directed into one of the plurality of outlet channels and passes by the sound emitted from the other horn section before exiting the horn. At lower frequencies, sound emanating from each horn section is widely dispersed due to diffraction at the horn outlets and appears to emanate from a single horn. At sufficiently high frequencies, sound emanating from each of the horn sections narrows and becomes more directional. However, because the outlet channels of the first and second horn sections are positioned at an angle relative to one another, the narrower dispersion from each horn section covers a separate portion of the horizontal plane. The effect is that the overall horizontal coverage remains relatively wide even at higher frequencies.

In some embodiments, a loudspeaker cabinet comprises a primary enclosure having a front wall, the front wall having an aperture in which a loudspeaker driver is mounted. The loudspeaker cabinet further comprises a top baffle section having a top end, and a bottom baffle section having a bottom end, each extending vertically from the primary enclosure. The top baffle section has a first width that gradually increases towards the top end, and the bottom baffle section has a second width that gradually increases towards the bottom end. The extended baffle sections cause vertically radiated sound from the loudspeaker driver to be reflected and directed forward, resulting in a relatively narrow vertical coverage pattern. In contrast, relatively shorter horizontal baffle sections cause horizontally radiated sound to diffract around the cabinet resulting in a wider dispersion of sound in the horizontal direction.

In some embodiments, a loudspeaker horn and cabinet system may be configured with a loudspeaker horn placed in front of a loudspeaker cabinet. The loudspeaker horn may be disposed a certain distance in front of the loudspeaker cabinet such that the amount of interference caused by sound emanating from both of the loudspeaker horn and loudspeaker cabinet is minimized.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. LOUDSPEAKER HORN

As described above, a loudspeaker horn generally is a device designed to efficiently project and guide sound generated by a sound source, such as a compression driver commonly found in loudspeakers, into particular directions or regions surrounding the sound source. In a typical horn arrangement, a compression driver generates sound through an outlet port that enters an opening in the horn, referred to as the horn throat. The horn throat extends from near the compression driver to a horn outlet, also referred to as the horn mouth. In general, a horn exhibits certain sound dispersion characteristics determined in large part by the shape of the horn. In instances where relatively narrow dispersion of sound in one direction and wide dispersion of sound in another spatial dimension is desired, a horn having a slot exit may be used.

FIG. 1 is a perspective view of a loudspeaker horn 100 having a slot exit 106. Loudspeaker horn 100 comprises a compression driver 102, horn throat 104, and slot exit 106. Slot exit 106 is illustrated as having a narrow width and relatively tall vertical height. In operation, sound generated by the compression driver 102 enters the horn throat 104 and is able to expand vertically as a result of the increasing vertical height of the horn throat 104 towards the slot exit 106. Upon exiting the slot exit 106, the vertical dispersion of the sound traveling through the horn 100 is approximately controlled by the vertical cross sectional shape of the slot exit 106. In contrast, sound traveling through horn 100 is constricted in the horizontal direction as a result of the constant and narrow horizontal width of the horn throat 104.

Figure 2B:
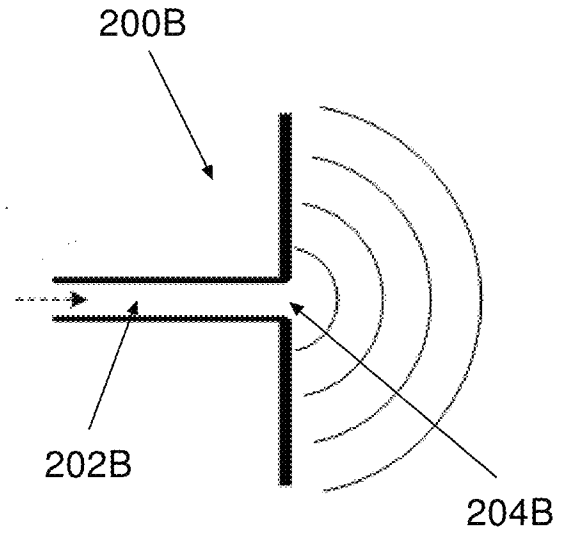
FIGS. 2A and 2B are views of the sound dispersion characteristics of a loudspeaker horn having a slot exit.
Figure 2A:
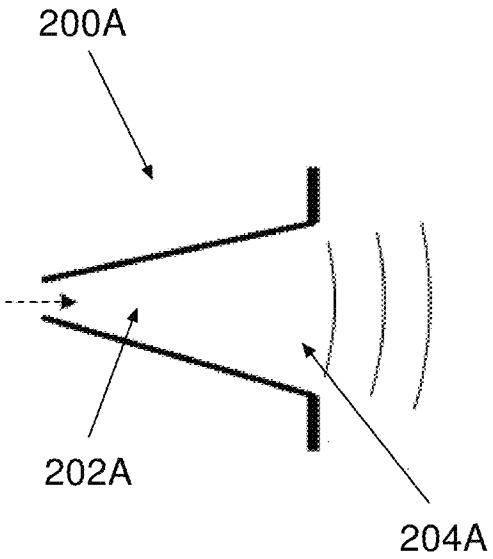

FIGS. 2A and 2B are views illustrating example sound dispersion characteristics of a loudspeaker horn having a slot exit, such as loudspeaker horn 100 illustrated in FIG. 1. For example, FIG. 2A is a cross sectional side elevation view of a horn 200A having a slot exit 204A. As illustrated by the dashed arrow, sound enters horn 200A at the horn throat 202A and travels through the horn throat 202A towards the slot exit 204A. As sound travels through the horn, the sound expands vertically as the height of the horn throat 202A increases. Upon exiting the slot exit 204A, the sound exhibits a vertical dispersion pattern that is approximately controlled by the height of the horn outlet, as illustrated by the curved lines exiting the horn 200A.

FIG. 2B is a top plane view of a horn having a slot exit. In contrast to FIG. 2A, sound entering the horn throat 202B travels through the horn towards the slot exit 204B and is constrained from expanding by the constant and narrow width of the horn throat 202B. As illustrated by the curved lines exiting slot exit 204B, sound exiting horn 200B is widely dispersed in the horizontal direction. The wide dispersion of sound exiting the horn 200B in the horizontal direction is a result of the sound diffracting out of the narrow opening of slot exit 204B in the horizontal direction.

As described above, only sounds with frequencies having wavelengths that are longer than approximately twice the width of a slot exit exhibit the wide diffraction pattern illustrated in FIG. 2B. At sufficiently high frequencies and correspondingly short wavelengths, sound emanating from a slot exit exhibits less dispersion and becomes more directional. In some embodiments, in order to maintain a wide horizontal dispersion pattern at higher frequencies, two or more separate horn sections may be used, the separate horn sections terminating in an interleaved column of outlet channels.

Figure 3:
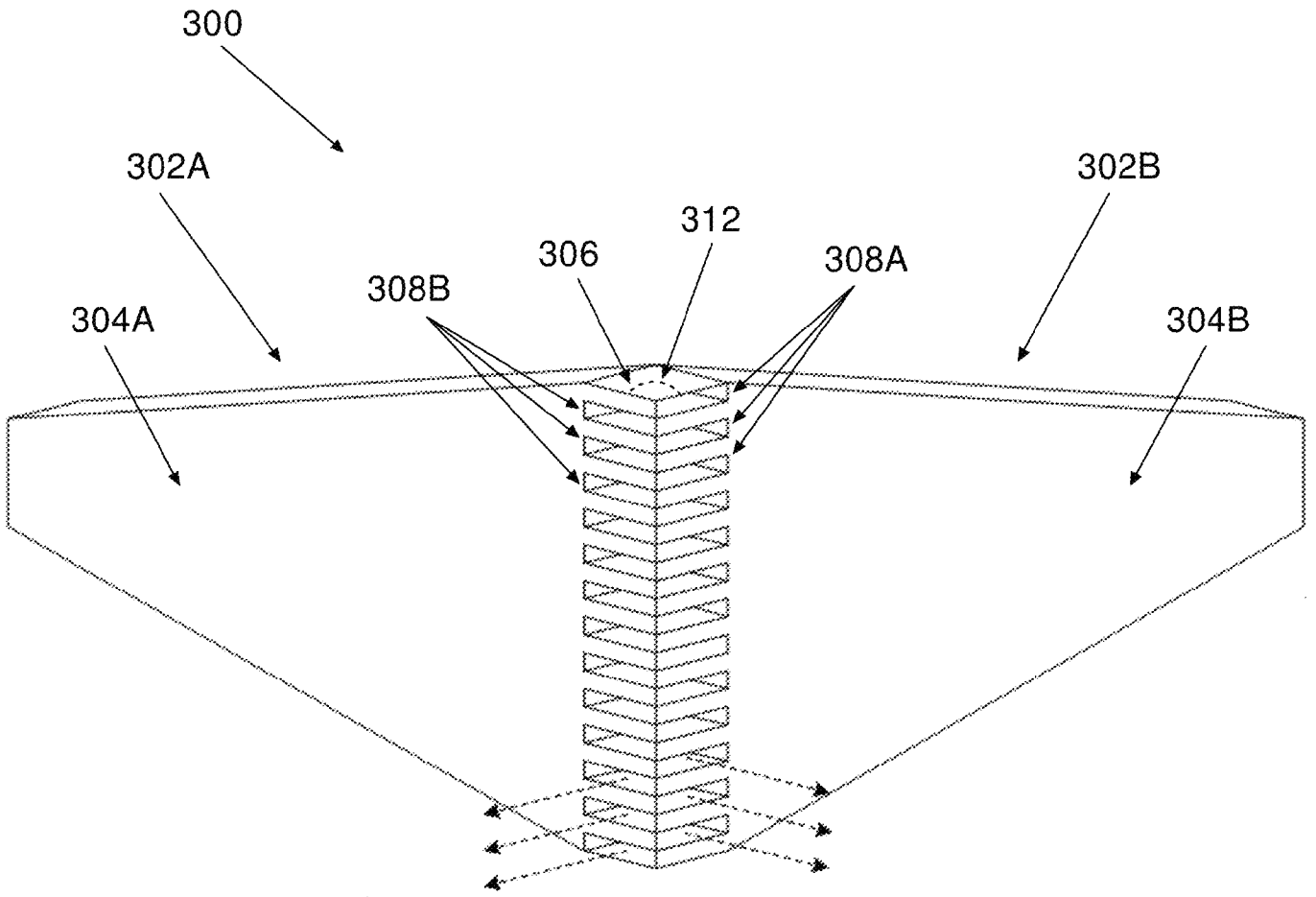
FIG. 3 is a front perspective view illustrating a loudspeaker horn having a column of interleaved outlet channels, according to an embodiment of the invention.

FIG. 3 is a front perspective view of a loudspeaker horn 300 having an interleaved column of outlet channels, according to an embodiment of the invention. Loudspeaker horn 300 comprises separate horn sections 302A, 302B, each extending from respective horn throats 304A, 304B to an interleaved column 306 of outlet channels 308A, 308B. Each of horn throats 304A, 304B may be coupled to separate compression drivers (not illustrated). The compression drivers may generate sound that enters the horn sections 302A, 302B at horn throats 304A, 304B and travels through the horn sections towards the outlet channels 308A, 308B.

Depending on the width of the outlet channels 308A, 308B, at relatively low to high frequencies (e.g., up to approximately 6 kHz for a width of approximately 25 mm), sound emanating from outlet channels 308A, 308B exhibits a wide horizontal dispersion pattern, similar to the dispersion pattern illustrated in FIG. 2B. The wide dispersion pattern from both of outlet channels 308A, 308B causes the sound to appear as if it is emanating from a single horn outlet.

At even higher frequencies (e.g., above approximately 6 kHz for an outlet channel width of 25 mm), the dispersion pattern of sound emanating from each of outlet channels 308A, 308B begins to narrow and is more directional along the paths indicated by the dashed line arrows in FIG. 3. However, the narrower dispersion patterns of each of outlet channels 308A, 308B cover separate portions of the horizontal plane due their angle relative to one another. As illustrated in FIG. 3, for example, horn outlet channels 308A are disposed in a first direction and the horn outlet channels 308B are disposed in a second direction, where the first direction is substantially perpendicular to the second direction. The result is that a wide horizontal area is covered by high frequency sounds emanating from the horn 300, even if the respective horn sections 302A, 302B are individually emitting sound with a relatively narrower horizontal dispersion pattern.

As used herein and in the claims, substantially perpendicular generally refers to an angle of approximately 90°. However, substantially perpendicular may also refer to angles greater than or less than 90°, e.g., substantially perpendicular may refer to an angle $\alpha$ between 60° and 120°. For example, horn outlet channels 308A, 308B in FIG. 3 are illustrated forming a front edge having an interior angle 312 of approximately 90°. In some embodiments, the interior angle 312 formed by the front edge may be more or less than 90° depending on a desired horizontal coverage pattern. For example, if a wider horizontal coverage pattern is desired, the interior angle 312 of the front edge formed by horn outlet channels 308A, 308B may be less than 90°. Similarly, if a narrower horizontal coverage pattern is desired, the interior angle 312 of the front edge formed by horn outlet channels 308A, 308B may be more than 90°.

In an embodiment, the interleaved column 306 of outlet channels causes sound waves exiting from horn section 302A at outlet channels 308A to move past sound waves exiting horn section 302B at outlet channels 308B. As a result, the sound waves exiting from horn section 302A are prevented from easily diffracting into horn section 302B, and vice versa. By preventing the sound waves exiting from one horn section from diffracting into the other horn section, interference from each of the separate horn sections is minimized.

In FIG. 3, two separate horn sections 302A, 302B are used to create the interleaved column 306 of outlet channels. In other embodiments, any number of separate horn sections may be used. For example, a third horn section could be placed between horn sections 302A, 302B, in order to direct sound more directly towards the front of horn 300. The outlet channels of a third horn could be interleaved between the outlet channels 308A, 308B in a similar fashion.

Figure 4:
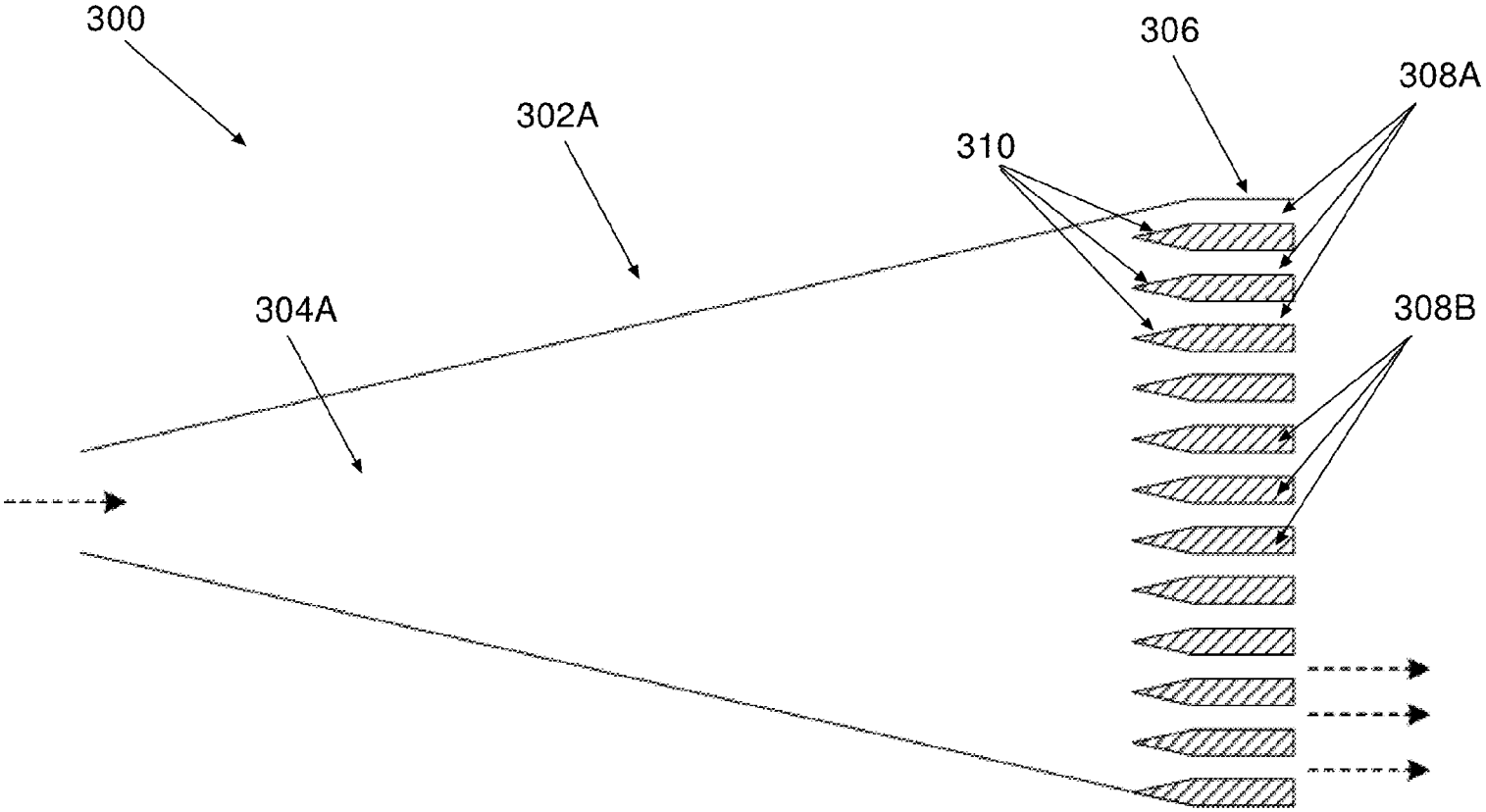
FIG. 4 is a cross sectional side elevation view illustrating a loudspeaker horn having a plurality of outlet channels, according to an embodiment of the invention.

FIG. 4 is a cross sectional side elevation view of the loudspeaker horn 300 illustrated in FIG. 3, according to an embodiment of the invention. As in FIG. 3, horn 300 of FIG. 4 comprises a horn section 302A including a horn throat 304A extending towards an interleaved column 306 of horn outlet channels 308A, 308B. The outlet channels 308B, illustrated by the shaded areas in the interleaved column 306, represent obstructions for sound waves traveling through horn section 302A. Similarly, outlet channels 308A represent obstructions for sound waves traveling through horn section 302B (not visible).

In an embodiment, the outlet channels may be defined by channel separators 310 which form an edge extending towards the inlet of horn throat 304A. In an embodiment, channel separators 310 may be formed as edges in order to reduce the amount of sound that may be reflected back towards horn throat 304A as the sound encounters the channel separators 310. In some instances, these reflections may cause audible distortion in sound exiting horn 300 and, thus, it may be desirable to minimize the amount of sound reflected by channel separators 310.

In an embodiment, the channel separators 310 may comprise any material and be of any thickness. For example, the material may be very thin (e.g., less than a millimeter) in order to maximize the area through which sound waves may pass through the outlet channels 308A, 308B. In one embodiment, the thickness of the material may be selected such that the channel separators 310 occupy less than 5% of the area within the interleaved column 306. In other words, the channel separators may have a thickness of less than 0.05 times the height of any particular outlet channel of outlet channels 308A, 308B.

In general, a loudspeaker horn is designed to provide a gradually expanding cross sectional area through which sound may travel. The expanding cross sectional area conducts sounds waves traveling through the horn and serves to increase the efficiency of the associated sound source. In contrast, areas of constriction within a horn (e.g., at the horn throat) may cause an increase in acoustic impedance that decreases the amount of sound energy projected from the horn and causes internal reflections which are audible as undesirable artefacts in the sound emanating from the horn. In FIG. 4, for example, the areas between channel separators 310 include areas that may slightly converge to form the outlet channels 308A. This narrowing of the cross sectional area within the horn section 302A may cause an increase in amount of acoustic impedance at the channel separators 310. In one embodiment, in order to further decrease the amount of constriction resulting from the channel separators, the channel separators may be further extended in the horn sections towards the respective horn throats.

Figure 5:
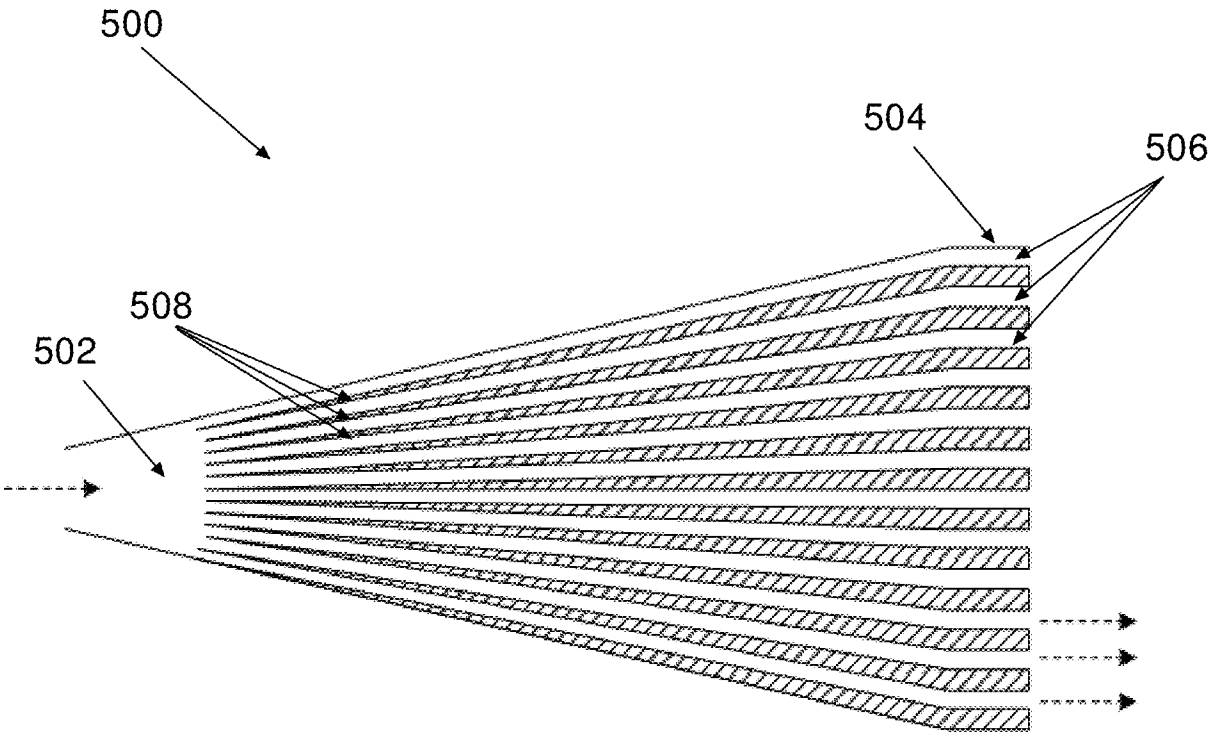
FIG. 5 is a cross sectional side elevation view illustrating a loudspeaker horn having extended outlet channel separators, according to an embodiment of the invention.

FIG. 5 is a cross sectional side elevation view illustrating a loudspeaker horn having extended outlet channel separators, according to an embodiment of the invention. Horn section 500 comprises a horn throat 502 that extends towards an interleaved column 504 of outlet channels 506. In FIG. 5, each of channel separators 508 is configured to extend a distance towards horn throat 502. For example, the channel separators 508 may extend at least half the distance or more of the horn section 500 towards horn throat 502. By extending the channel separators 508 farther towards the horn throat, the amount of constriction within each of the outlet channels 506 is further reduced. For example, as illustrated in FIG. 5, each of the separate outlet channels 506 begins near horn throat 502 and exhibits a slightly increasing cross sectional area as the channel extends towards the horn outlet.

For a loudspeaker horn such as the one illustrated in FIG. 3, depending on the dimensions of the individual outlet channels, transverse resonances may occur for sound waves having wavelengths that correspond to approximately twice the height or width of each individual outlet channel. For example, an individual outlet channel having exit dimensions of 25 mm by 4 mm may exhibit transverse resonances for sounds with frequencies of approximately 6.9 kHz and 42.9 kHz (and multiples of these frequencies). The occurrence of transverse resonances within the outlet channels may result in colorations of the noise emanating from the horn.

The frequencies at which the outlet channels exhibit transverse resonances may be altered by further reducing the dimensions of the individual outlet channels. In one embodiment, in order to reduce the dimensions of the outlet channels, each of the channels may be subdivided into two or more sub-channels. By further reducing the dimensions of the outlet channels, the frequencies at which transverse resonances may occur may be pushed to even higher frequencies.

Figure 6:
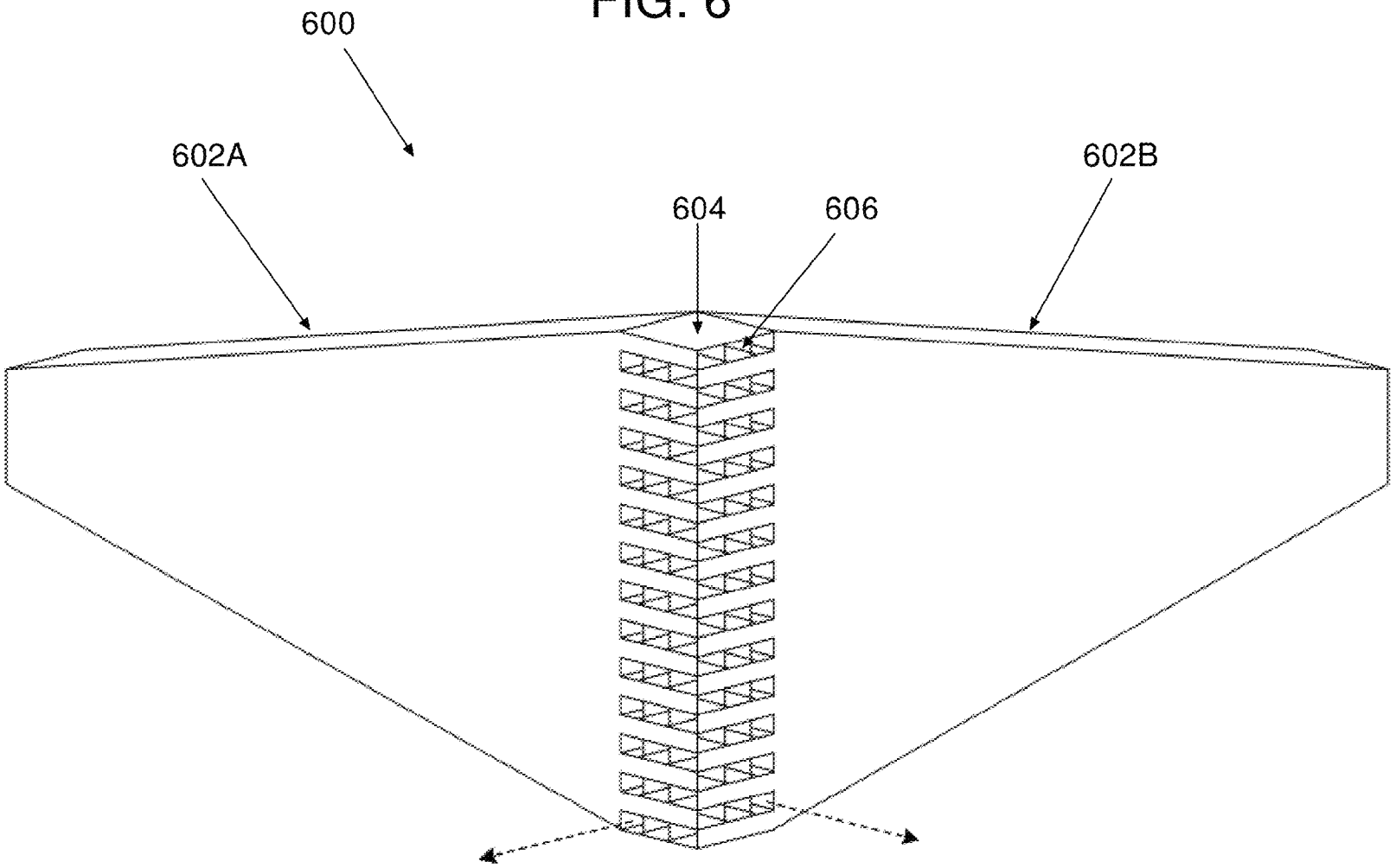
FIG. 6 is a front perspective view illustrating a loudspeaker horn having a column of interleaved outlet channels each comprising one or more channel dividers, according to an embodiment of the invention.

FIG. 6 is front perspective view illustrating a loudspeaker horn 600 having an interleaved column of outlet channels each comprising one or more channel dividers, according to an embodiment of the invention. Similar to loudspeaker horn 300 illustrated in FIG. 3, horn 600 comprises separate horn sections 602A, 602B which terminate in an interleaved column 604 of outlet channels, including outlet channel 606. Outlet channel 606 comprises two channel dividers (partially visible) which subdivide outlet channel 606 into three separate sub-channels. While two channel dividers are illustrated in FIG. 6, in other embodiments, any number of channel dividers may be used depending on the desired dimensions of the sub-channels.

In FIGS. 3 and 6, the front leading edge of loudspeaker horns 300, 600 is illustrated as a sharp edge. In some instances, the sharp edge may act as a separate sound source as sound emanating from the horns is diffracted by the edge. This diffraction by the leading edge may sometimes be audible as spectral coloration as the sound diffracted from the edge mixes with the sound emanating from the outlet channels, thereby causing some frequencies to be canceled and others reinforced. In some embodiments, the leading edge of the loudspeaker horn instead may be rounded in order to reduce diffraction of sound exiting the horn by the leading edge.

Figure 7:
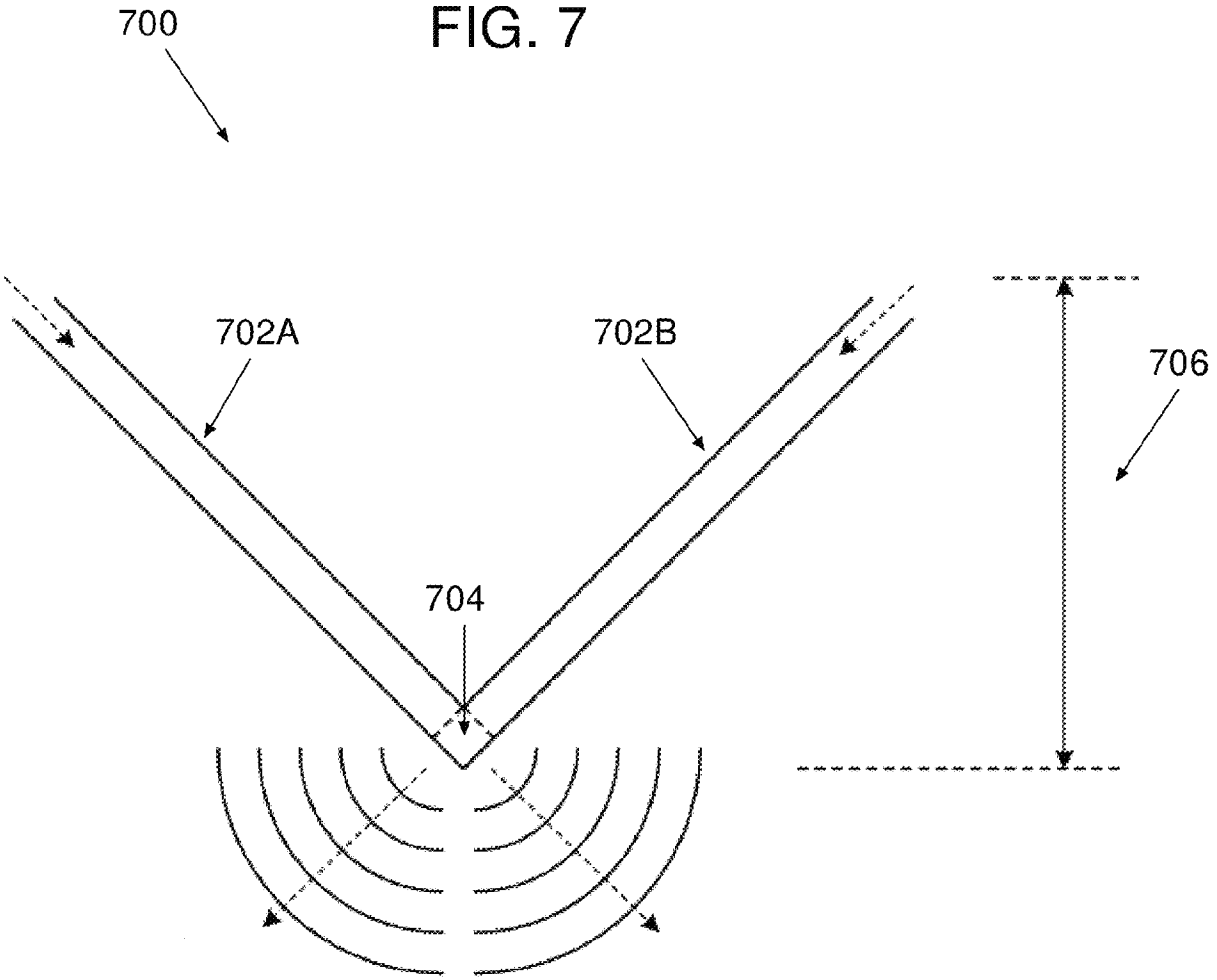
FIG. 7 is a top plan view illustrating a loudspeaker horn having substantially perpendicular horn throat sections, according to an embodiment of the invention.

FIG. 7 is a top plane view illustrating a loudspeaker horn 700 having substantially perpendicular horn sections 702A, 702B, according to an embodiment of the invention. In FIG. 7, horn sections 702A, 702B terminate at interleaved column 704 of outlet channels. Each of the horn sections 702A, 702B extends some distance substantially perpendicular to one another from respective horn throats towards the interleaved column 704 of outlet channels. As a result, the front to back distance of horn 700 is proportional to the length of the two horns, as illustrated by the distance 706. If horn 700 is mounted on a wall, for example, the horn may protrude from the wall a distance 706. In some circumstances, it may be desirable to configure a loudspeaker horn to minimize the front to back distance and, thus, decrease the amount of protrusion of the horn when mounted on a surface.

Figure 8:
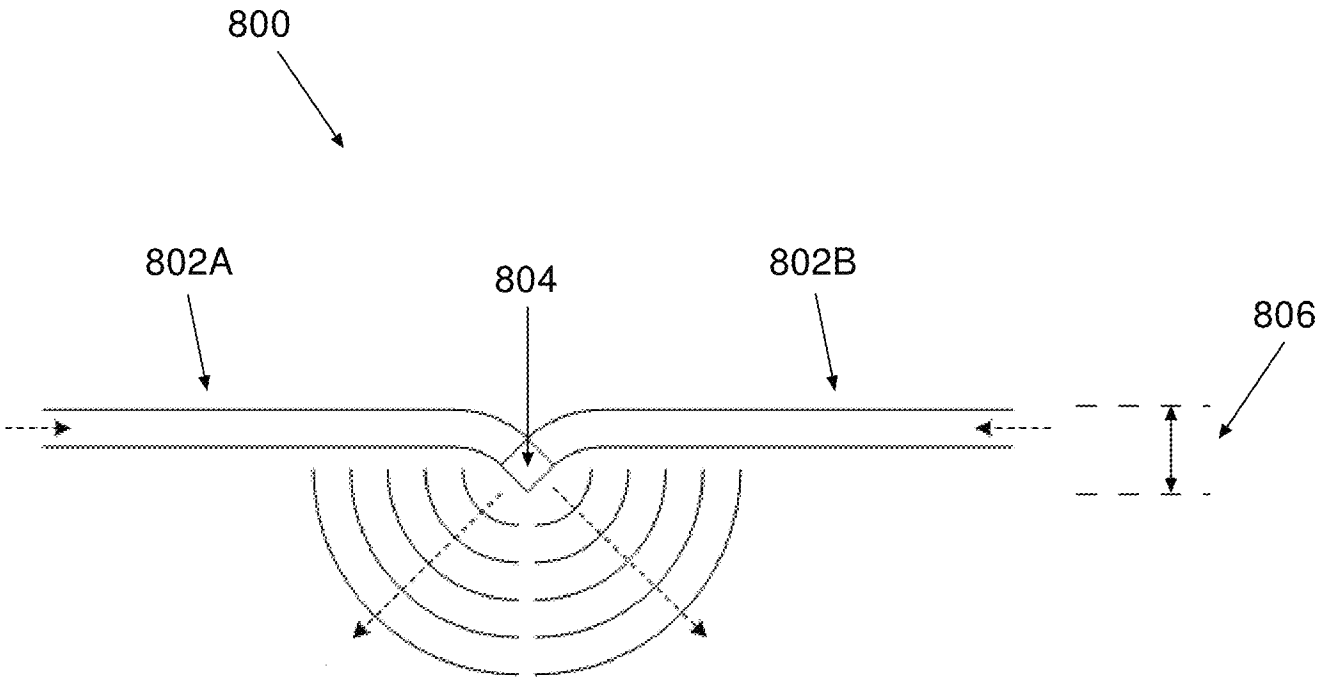
FIG. 8 is a top plan view illustrating a loudspeaker horn having substantially parallel horn throat sections, according to an embodiment of the invention.

FIG. 8 is a top plane view illustrating a loudspeaker horn 800 having substantially parallel horn sections 802A, 802B. In FIG. 8, horn sections 802A, 802B are configured substantially parallel to one another and angled only near the interleaved column 804 of outlet channels. In an embodiment, by arranging the length of horn sections 802A, 802B substantially parallel to one another, the front to back distance 806 may be significantly decreased, as illustrated by the distance 806.

3. LOUDSPEAKER CABINET

Loudspeakers often comprise multiple independent loudspeaker drivers, each optimized for a particular frequency range. For example, a common loudspeaker configuration is a two-way loudspeaker having a low frequency driver, typically a cone, and a separate high frequency driver, typically a compression driver. While a high frequency driver may be coupled to a horn, as described above, low frequency drivers may typically be mounted in a larger enclosure such as a loudspeaker cabinet.

A low frequency driver mounted in a loudspeaker cabinet generally has a sound dispersion or directivity characteristic which is wide, often omnidirectional, at low frequencies and narrower at higher frequencies. The frequency below which a low frequency loudspeaker driver is essentially omnidirectional depends in part on the dimensions of the cabinet enclosing the driver. In particular, the directivity of sound waves emanating from a loudspeaker cabinet may be controlled by one or more faces of the cabinet surrounding the low frequency driver, referred to herein as a baffle.

As used herein, a baffle generally refers to any surface of a loudspeaker cabinet surrounding a driver mounted in the cabinet and that is capable of reflecting sound of certain wavelengths generated by the driver that may otherwise radiate in an omnidirectional pattern. For example, in a typical loudspeaker cabinet, the baffle generally corresponds to the front face of the cabinet.

The range of sound frequencies and corresponding wavelengths which a baffle is capable of reflecting depends in large part on the dimensions of the baffle. For example, sound frequencies having wavelengths that are longer than approximately twice the length of the baffle from the speaker in any particular direction are not affected by the baffle and radiate in an omnidirectional pattern. Frequencies with wavelengths shorter than the baffle length in any particular direction radiate forward from the loudspeaker cabinet with a dispersion pattern that is approximately controlled by the shape of the baffle. For frequencies and wavelengths in between, the sound is dispersed proportionally between omnidirectional and directional.

In one embodiment, the dispersion characteristics of a loudspeaker cabinet may be tuned by increasing or decreasing the amount of surface area surrounding a loudspeaker driver mounted in the cabinet. In addition, the dispersion characteristics may be different in one direction than another by increasing the length of the baffle more in one axis than another. For example, if it desired that the cabinet exhibit less vertical dispersion, the baffles of the cabinet may be extended in the vertical direction. Conversely, if more horizontal dispersion is desired, the baffle may be narrow in the horizontal direction in order to cause sound to widely diffract around the cabinet.

Figure 9:
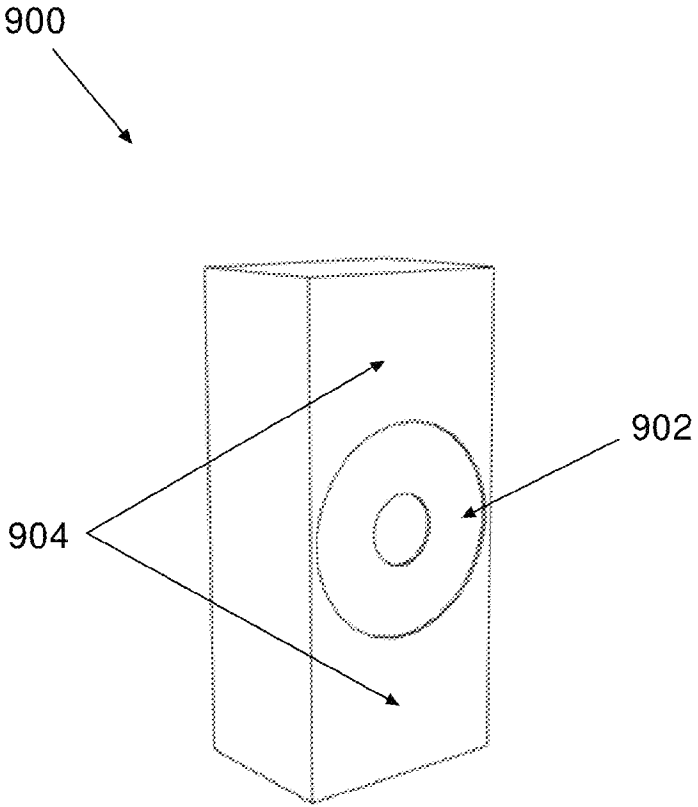
FIG. 9 is a perspective view illustrating a loudspeaker cabinet with vertically extended baffle sections, according to an embodiment of the invention.

FIG. 9 is a perspective view of a loudspeaker cabinet 900 with vertically extended baffle sections 904, according to an embodiment of the invention. Loudspeaker cabinet 900 comprises a low frequency driver 902 that is mounted in an aperture in the front face of the cabinet 900. The cabinet 900 is configured such that the lengths of baffle sections 904 are extended vertically relative to the length of the baffle in the horizontal direction.

Baffle sections 904 illustrate an example of baffle sections that may be used to alter sound dispersion characteristics of a loudspeaker cabinet more in one direction relative to another. As described above, sound frequencies having a wavelength that is shorter than the length of a baffle are influenced by the baffle and exhibit more controlled directivity. Because sound from the low frequency driver 902 radiates outwards in both horizontal and vertical directions, the vertically extended baffle sections 904 affect a relatively wide range of sound frequencies compared to the horizontal direction. As a result, loudspeaker cabinet 900 causes relatively more sound to be radiated forward from the cabinet in the vertical direction.

In contrast, cabinet 900 is illustrated having narrow horizontal baffle sections surrounding low frequency driver 902. As a result, the side edges of the cabinet 900 cause more of the sound emanating from the low frequency driver 902 to be diffracted in the horizontal direction as the sound encounters the side edges of the cabinet 900. Thus, the combination of the vertically extended baffle sections 904 and the narrow horizontal baffle sections results in a relatively narrow sound coverage pattern in the vertical direction and a wide sound coverage pattern in the horizontal direction.

Figure 10:
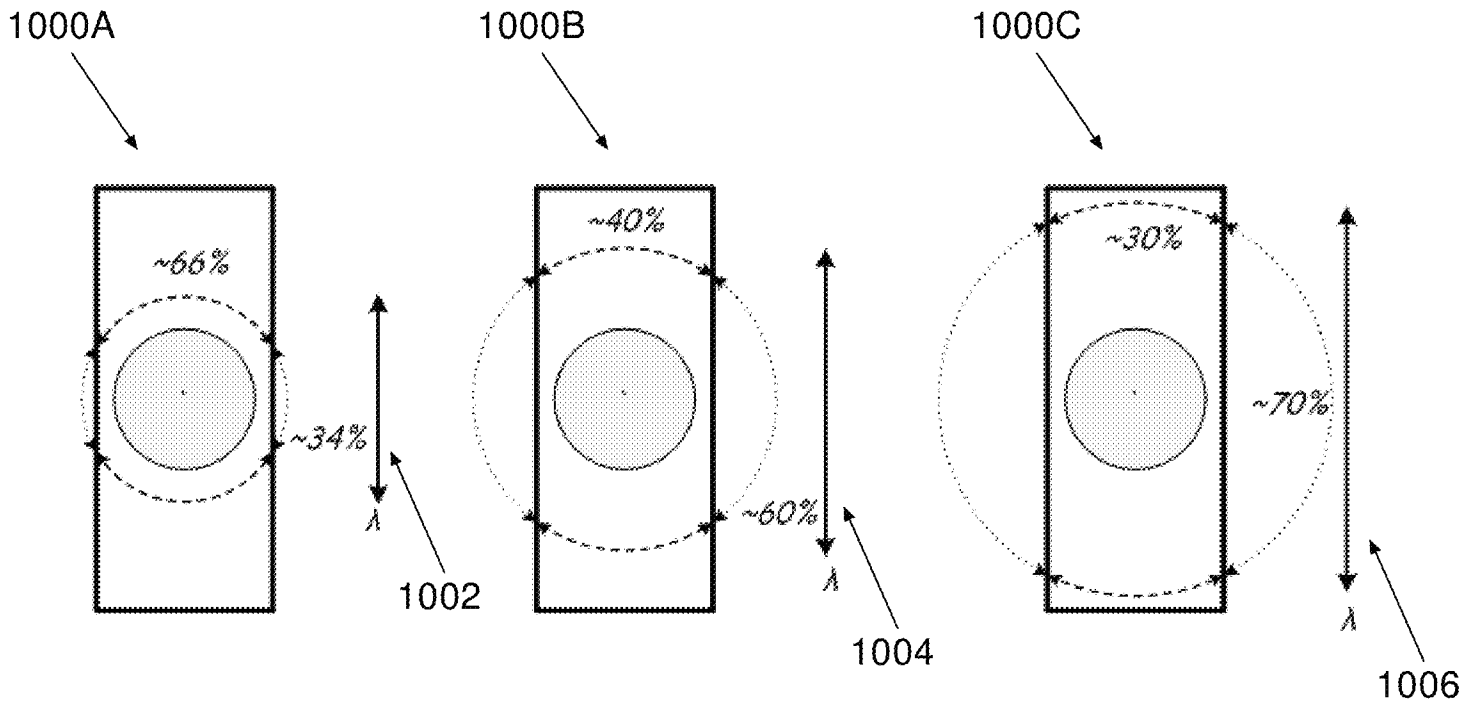
FIG. 10 is an illustration of sound dispersion control of a loudspeaker cabinet having a vertically extended baffle, according to an embodiment of the invention.

FIG. 10 illustrates front elevation views 1000A-1000C of a loudspeaker cabinet having vertically extended baffle sections, according to an embodiment of the invention. The dashed circles overlaying the illustrated loudspeaker cabinet in FIG. 10 indicate an approximate amount of sound that is affected by the baffle at various wavelengths. For example, view 1000A illustrates that at an example wavelength 1002, the baffle influences approximately 66% of sound emanating from the driver. As indicated by the bolded section of the dashed circle in view 1000A, the majority of the sound is reflected by the vertically extended baffle sections, while a portion of the sound radiates around the narrow dimensions of the baffle in the horizontal direction.

View 1000B illustrates that as the wavelength 1004 increases, the vertically extended baffle sections influence an increasingly smaller percentage of the emanated sound waves. View 1000C illustrates that as the wavelengths approach the length of the vertically extended baffle sections, for example, the baffle may influence only 30% of the radiated sound. In view 1000C, rather than being reflected by the vertically extended baffle sections, approximately 70% of the sound diffracts, by varying amounts, around the sides of the cabinet.

Figure 11:
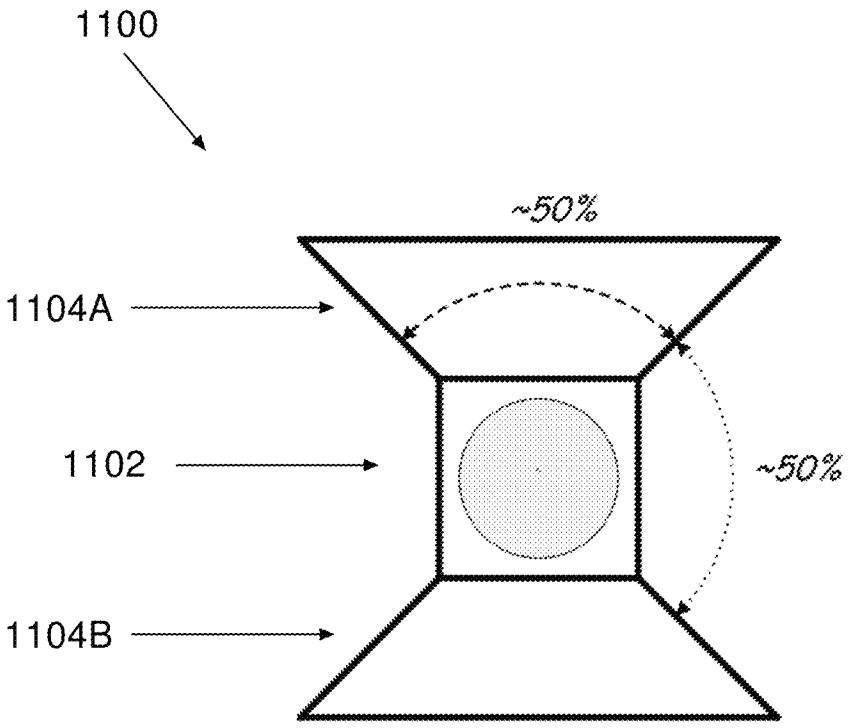
FIG. 11 is a front elevation view illustrating a loudspeaker cabinet having a vertically extended baffle with top and bottom baffle sections that gradually increase in width, according to an embodiment of the invention.

In one embodiment, in order to have baffle sections that more consistently reflect sound as wavelengths increase, the vertically extended baffle sections may have a width that gradually increases towards the top and bottom of the cabinet. FIG. 11 is a front elevation view illustrating a loudspeaker cabinet 1100 having a vertically extended baffle with top and bottom baffle sections that gradually increase in width, according to an embodiment of the invention. Loudspeaker cabinet 110 comprises a primary enclosure 1102, a top baffle section 1104A, and a bottom baffle section 1104B. Top baffle section 1104A, for example, begins at the top of the primary enclosure 1102 having a width that is approximately equal to the width of the primary enclosure. As illustrated in FIG. 11, the width of the top baffle section 1104A gradually increases towards the top end of the baffle section.

The gradual increase in width may be used to direct forward a more consistent proportion of the radiated sound as the wavelength of the sound increases. For example, as indicated by the dashed circle, as the wavelength of the sound increases, the gradually widening of the top and bottom baffle sections may result in reflecting approximately 50% of the radiated sound for a range of wavelengths.

Although in FIG. 11 the top and bottom baffle sections 1104A, 1104B are illustrated as being substantially symmetrical, in other embodiments, the overall height, width, and rate of width increase in the top and bottom baffle sections 1104A, 1104B may be different from one another depending on the desired dispersion characteristics in the vertical direction.

Figure 12B:
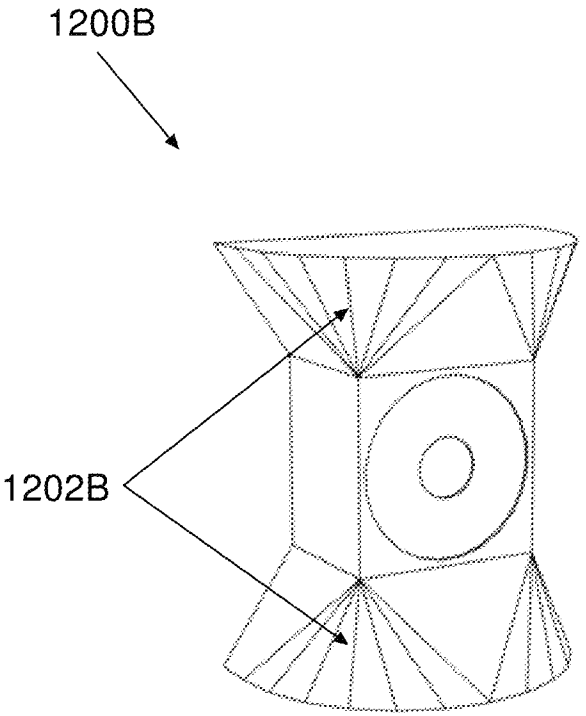
FIGS. 12A and 12B are perspective views of a loudspeaker cabinet having a vertically extended baffle that is tapered forward, according to an embodiment of the invention.
Figure 12A:
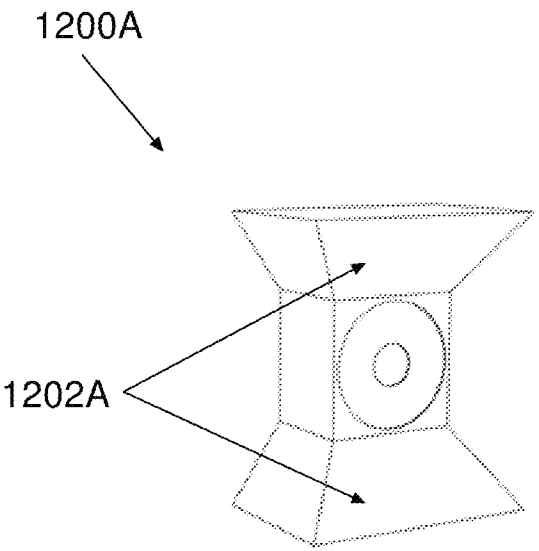

FIGS. 12A and 12B are perspective views illustrating a loudspeaker cabinet with a vertically extended baffle that gradually increases in width and is tapered forward, according to an embodiment of the invention. A flat baffle influences frequencies with a wavelength that is shorter than the baffle width into radiating in a hemispherical direction forward of the loudspeaker. In an embodiment, more control can be achieved by tapering the baffle forward in the desired direction of radiation of sound from the loudspeaker. The effect is similar, for example, to placing a horn in front of the loudspeaker in only one dimension.

In FIG. 12A, vertically extended baffle sections 1202A are tapered forward in a substantially symmetrical fashion. In other embodiments, the top and bottom baffle sections may be tapered forward at different degrees depending on a desired directivity of sound in the vertical direction. For example, if the cabinet 1200A is to be mounted high on a wall relative to an audience area, the top baffle section may be tapered forward more relative to the bottom baffle section in order to direct sound in a more downward direction towards the audience.

In an embodiment, one or more edges of the cabinet may be rounded in order to reduce distortions that may be caused due to edge diffraction. FIG. 12B, for example, illustrates a cabinet 1200B with top and bottom baffle sections 1202B having several substantially rounded edges. Although not depicted, any of the top and bottom edges of the baffle sections 1202B and side edges of the primary enclosure of cabinet 1200B similarly could be rounded if desired.

In one embodiment, the loudspeaker cabinet may be a ported (or bass reflex) cabinet. If a ported cabinet design is used, the ports may be placed near the loudspeaker and close to the center of the cabinet. In this manner, the sound emanating from the ports may also benefit from the directive characteristics of the cabinet shape in a manner similar to sound emitted by the loudspeaker driver.

4. LOUDSPEAKER HORN AND CABINET SYSTEM

In the sections above, a loudspeaker horn is described that is generally configured to disperse higher frequency sounds, and a loudspeaker cabinet is described that is generally configured to disperse lower frequency sounds. In an embodiment, wide horizontal dispersion and narrow vertical dispersion may be achieved across a wide range of sound frequencies with a loudspeaker horn and cabinet system wherein the loudspeaker horn is placed a short distance in front of the cabinet and possibly driven by a common audio signal source.

Figures 13A, 13B:
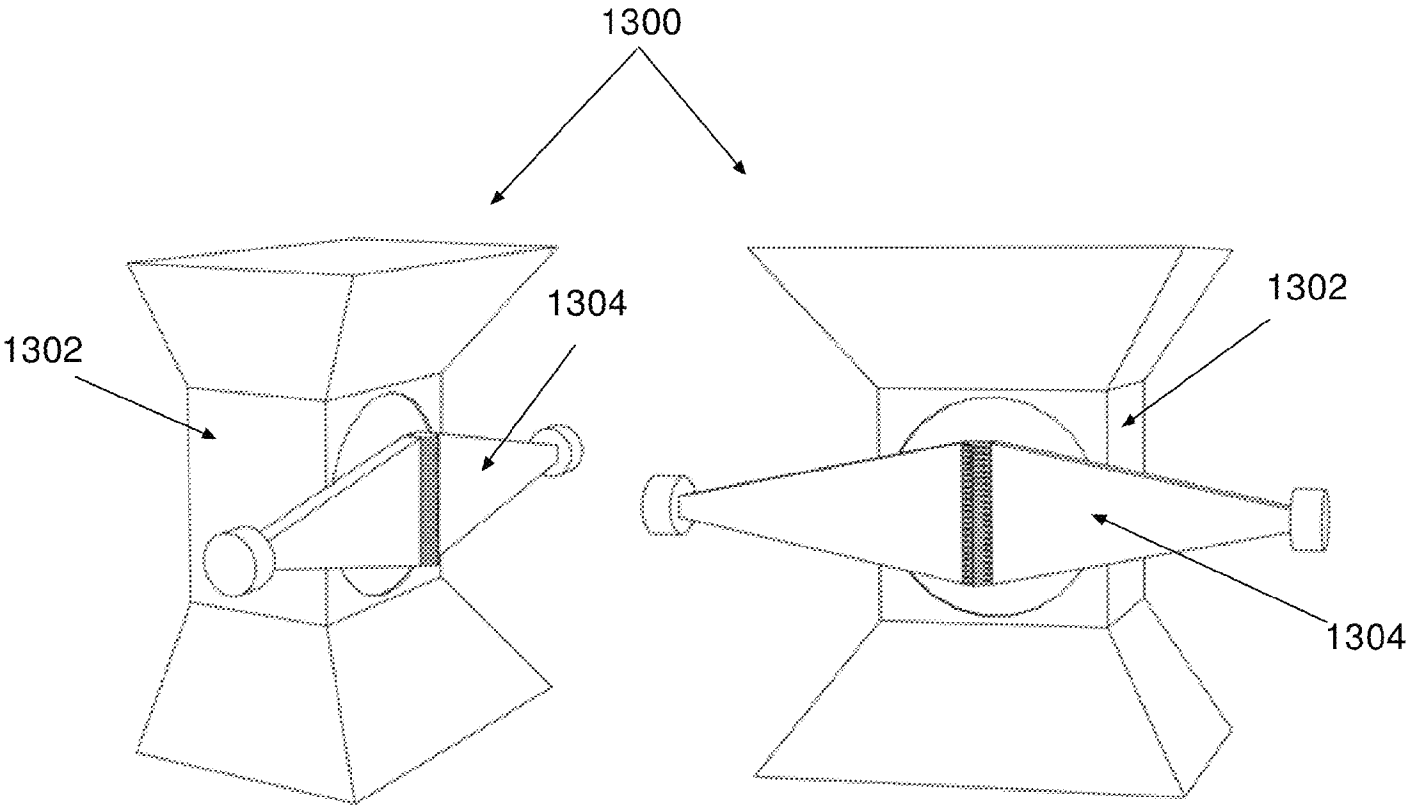
FIGS. 13A and 13B are a perspective and front elevation view of a loudspeaker horn and cabinet system, according to an embodiment of the invention.

FIGS. 13A and 13B are views of a loudspeaker horn and cabinet system 1300. In FIG. 13A, loudspeaker horn and cabinet system comprises loudspeaker cabinet 1302 and loudspeaker horn 1304. FIG. 13B is a front elevation view illustrating the loudspeaker horn and cabinet system 1300. In FIGS. 13A and 13B, the separate horn sections of loudspeaker horn 1304 are configured substantially parallel to one another in order to reduce the distance the loudspeaker horn protrudes from the loudspeaker cabinet 1302, as described above in relation to FIG. 8. In an embodiment, loudspeaker cabinet 1302 and loudspeaker horn 1304 may be physically separate and individually mounted or they may be coupled to another using any number of coupling means.

In one embodiment, audio signals received by the loudspeaker horn and cabinet system 1300 are split into two bands. Audio signal components with frequencies below a certain crossover frequency may be routed to the low frequency loudspeaker driver. Similarly, audio signal components with frequencies above the crossover frequency may be routed to the loudspeaker horn.

Audio filters used to split audio signals into multiple bands have a transition behavior. A low-pass filter used to create the low frequency band begins to attenuate audio signal frequencies very near the crossover frequency and attenuates frequencies more as the frequency level increases. Conversely, a high-pass filter used to create the high frequency band begins to attenuate the audio signal very near the crossover frequency and attenuates frequencies more with decreasing frequency level. For audio signal components that are approximately at the crossover frequency, both the high frequency driver of the horn 1304 and low frequency driver of the cabinet 1302 may emit sound.

Because the loudspeaker horn 1304 is disposed in front of the low frequency driver of the cabinet 1302, the distance from each of these sound sources may be different to a listener depending on where the listener is positioned relative to the loudspeaker horn and cabinet system 1300. For example, the greatest distance difference occurs for a listener positioned directly in front of the loudspeaker where the loudspeaker horn 1304 is closer to the listener than the lower frequency driver of the cabinet 1302 by a distance equal to the distance between the horn and the low frequency driver. Conversely, the smallest distance difference occurs for a listener positioned directly to the side of the loudspeaker horn and cabinet system 1300, where the loudspeaker horn 1304 and the low frequency driver of the cabinet 1302 are approximately the same distance from the listener.

The difference in distance to a listener between the high frequency driver and the low frequency driver results in a relative time delay to a listener of sound emitted by the loudspeaker horn and cabinet system 1300. This time delay produces a relative phase difference in sound emitted by the respective loudspeakers. If the relative phase difference at the crossover frequency is approximately 180 degrees, frequencies around the crossover frequency may cancel, causing a loss of sound energy.

In one embodiment, loss of sound energy may be minimized by ensuring that the relative phase difference in sound emitted by the loudspeaker horn 1304 and cabinet 1302 is less than approximately 45 degrees at the crossover frequency. As an example, if the crossover frequency is 1 kHz, 45 degrees corresponds to approximately 4.25 cm. Thus, the loudspeaker horn may be placed approximately twice this distance, or 8.5 cm in front of the low frequency driver of the cabinet 1302. Further, the total acoustic and electrical delay may be adjusted such that the absolute relative phase difference both forward and to the sides is 45 degrees.

Figure 14:
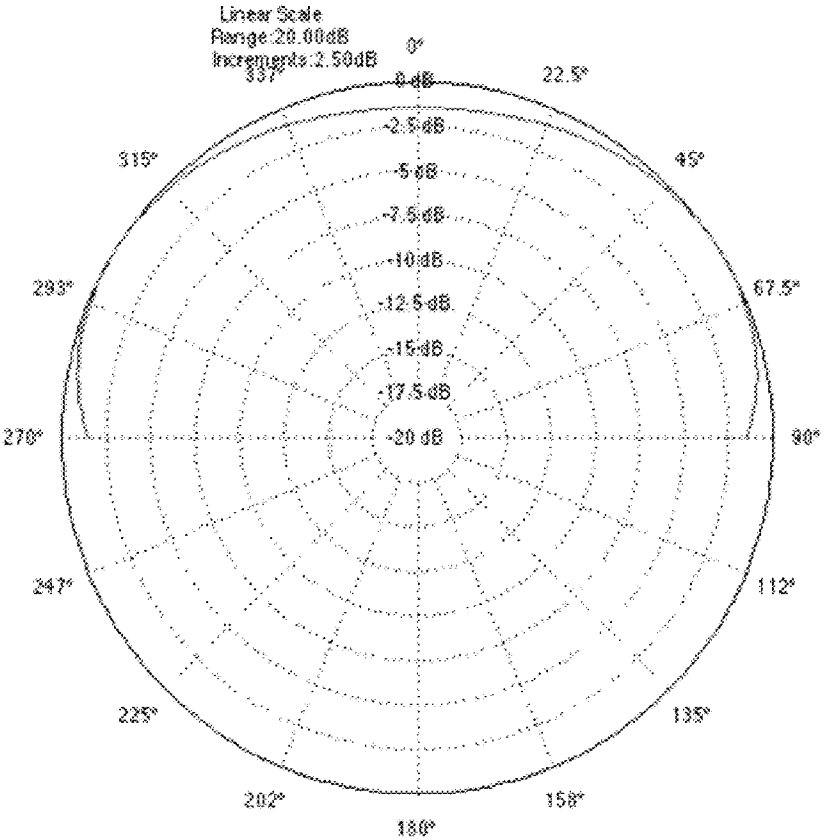
FIG. 14 is a polar plot illustrating example variations in the sound level of the loudspeaker horn and cabinet system of FIG. 13 in relation to the horizontal position of a listener, according to an embodiment of the invention.

FIG. 14 is a polar plot illustrating example variations in the sound level of the loudspeaker horn and cabinet system of FIG. 13 in relation to the horizontal position of a listener, according to an embodiment. For example, the polar plot may illustrate the variation in sound level for a loudspeaker horn and cabinet configured as indicated in the preceding paragraph. As illustrated in FIG. 14, the loss of sound energy is at most approximately 1.4 dB and only at listening positions directly to the front and sides of the loudspeaker system.

Note that, although separate embodiments are discussed herein, any combination of embodiments and/or partial embodiments discussed herein may be combined to form further embodiments.

5. EQUIVALENTS, EXTENSIONS, ALTERNATIVES AND MISCELLANEOUS

In the foregoing specification, example embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A loudspeaker horn, comprising:

first and second horn sections, each extending from an inlet to a mouth;

wherein the first horn section includes a first plurality of outlet channels, and wherein the second horn section includes a second plurality of outlet channels;

wherein the first plurality of outlet channels are disposed in an interleaved column with the second plurality of outlet channels, each channel in the first plurality of channels is positioned above or below a channel in the second plurality of channels in the interleaved column;

wherein the first plurality of outlet channels are disposed in a first direction and the second plurality of outlet channels are disposed in a second direction, and wherein the first direction is substantially perpendicular to the second direction.

2. The loudspeaker horn of claim 1, further comprising a plurality of electroacoustical drivers for generating sound waves over a range of frequencies, each having a sound outlet port;

wherein the inlet of each respective horn section is acoustically coupled to the outlet port of an electroacoustical driver of the plurality of electroacoustical drivers.

3. The loudspeaker horn of claim 1, wherein the first plurality of outlet channels are defined by a plurality of channel separators.

4. The loudspeaker horn of claim 3, wherein the channel separators have a thickness of less than 0.05 times the height of a particular outlet channel of the first plurality of outlet channels.

5. The loudspeaker horn of claim 1, wherein each of the channel separators forms an edge extending towards the inlet of the first horn section.

6. The loudspeaker horn of claim 5, wherein the edge extends at least half of the length of the first horn section.

7. The loudspeaker horn of claim 1, wherein each outlet channel of the first plurality of outlet channels comprises one or more channel dividers, wherein the one or more channel dividers subdivide the first plurality of outlet channels into a plurality of sub-channels.

8. The loudspeaker horn of claim 1, wherein a leading edge of the horn is substantially rounded.

9. The loudspeaker horn of claim 1, wherein the first horn section and the second horn section are substantially parallel to one another.

10. The loudspeaker horn of claim 1, wherein an interior angle formed by the first plurality of outlet channels and the second plurality of outlet channels is greater or less than 90°.

11. A loudspeaker cabinet, comprising:

a primary enclosure having a front wall, the front wall having an aperture in which a low frequency loudspeaker driver is mounted;

a top baffle section having a top end and a bottom baffle section having a bottom end, each of the top baffle section and bottom baffle section extending vertically from the primary enclosure, each of the top baffle section and the bottom baffle having interior volumes contiguous with the primary enclosure's interior volume;

wherein the top baffle section has a first width that gradually increases towards the top end and the bottom baffle section has a second width that gradually increases towards the bottom end;

wherein one or more of the top baffle section or the bottom baffle section has one or more edges that are substantially rounded.

12. The loudspeaker cabinet of claim 11, wherein the top baffle section is tapered forward.

13. The loudspeaker cabinet of claim 11, wherein the bottom baffle section is tapered forward.

14. The loudspeaker cabinet of claim 11, wherein the top and bottom baffle sections are tapered forward, wherein the top baffle section is tapered forward from the primary enclosure at a first angle and the to the bottom baffle section is tapered forward from the primary enclosure at a second angle, and wherein the first angle and the second angle are different.

15. The loudspeaker cabinet of claim 11, wherein the primary enclosure has one or more edges that are substantially rounded.

16. The loudspeaker cabinet of claim 11, further comprising a loudspeaker horn disposed in front of the primary enclosure.

17. The loudspeaker cabinet of claim 16, wherein the loudspeaker horn is mounted in front of the low frequency loudspeaker driver which minimizes interference of sounds emanating from both of the loudspeaker horn and the low frequency loudspeaker driver.

18. A loudspeaker horn and cabinet, comprising:

a loudspeaker cabinet having a front wall, the front wall having an aperture in which a low frequency loudspeaker driver is mounted;

a loudspeaker horn mounted in front of the loudspeaker cabinet, the loudspeaker horn having a first plurality of outlet channels and a second plurality of outlet channels;

wherein the first plurality of outlet channels are disposed in an interleaved column with the second plurality of outlet channels, each channel in the first plurality of channels is positioned above or below a channel in the second plurality of channels in the interleaved column;

wherein the first plurality of outlet channels are disposed in a first direction and the second plurality of outlet channels are disposed in a second direction, and wherein the first direction is substantially perpendicular to the second direction.

19. The loudspeaker horn and cabinet of claim 18, the loudspeaker cabinet further comprising:

a top baffle section having a top end and a bottom baffle section having a bottom end, each of the top baffle section and the bottom baffle section extending vertically from the primary enclosure;

wherein the top baffle section has a first width that gradually increases towards the top end and the bottom baffle section has a second width that gradually increases towards the bottom end.

* * * * *